US007422413B2

(12) United States Patent
Matheny

(10) Patent No.: US 7,422,413 B2
(45) Date of Patent: Sep. 9, 2008

(54) SHROUD TIP CLEARANCE CONTROL RING

(75) Inventor: Alfred P Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 539 days.

(21) Appl. No.: 11/153,193

(22) Filed: Jun. 15, 2005

(65) Prior Publication Data

US 2006/0285971 A1 Dec. 21, 2006

(51) Int. Cl.
*F01D 11/08* (2006.01)

(52) U.S. Cl. ..... 415/1; 415/126; 415/136; 415/138; 415/173.2; 415/173.6

(58) Field of Classification Search ..... 415/1, 415/126, 127, 128, 136, 138, 173.2, 173.6, 415/174.1
See application file for complete search history.

(56) References Cited

U.S. PATENT DOCUMENTS 3,085,398 A * 4/1963 Ingleson ..... 415/127
3,807,891 A * 4/1974 McDow et al. ..... 415/116
4,343,592 A * 8/1982 May ..... 415/173.2
5,049,033 A * 9/1991 Corsmeier et al. ..... 415/173.2
5,056,988 A * 10/1991 Corsmeier et al. ..... 415/173.2
5,330,321 A * 7/1994 Roberts et al. ..... 415/136
6,935,836 B2 * 8/2005 Ress et al. ..... 415/173.2

* cited by examiner

*Primary Examiner*—Igor Kershteyn
(74) *Attorney, Agent, or Firm*—John Ryznic

(57) ABSTRACT

The present invention is a shroud tip clearance control ring for use in a gas turbine engine in which a rotary blade and a shroud ring form a gap that forms a blade outer air seal, and where the shroud ring is formed of two shroud segment halves, each shroud segment including a pin located near an end of the segment, the pins being slidably within slots formed on the casing, and a drive member moves along a direction in which the pins are moved along the slots to change a radius of the shroud ring in a way such that the radius remains substantially the same along a 360 degree angle of the shroud ring. The drive member includes two positions, one that places the shroud ring in a radially inward position, and another position that places the shroud ring in a radially outward position.

7 Claims, 3 Drawing Sheets

SHROUD TIP CLEARANCE CONTROL RING

BACKGROUND OF THE INVENTION

1. Field of the Invention

The present invention relates to a gas turbine engine, and more particularly to a shroud tip ring that forms a blade outer air seal with a blade tip of the engine.

2. Description of the Related Art Including Information Disclosed Under 37 CFR 1.97 and 1.98

A gas turbine engine includes a row of rotating blades. These rotating blades define a space between a blade tip and an inner shroud of the casing. This space or gap allows for the gas or air in the turbine engine to flow around or bypass the blades such that no work is extracted. It is desirable to minimize this gas to prevent as much airflow bypass as possible without rubbing the blade tips against the inner-casing surface.

During startup or transient operation of the turbine engine, the gap between the shroud and the blade tip can be greater than a gap when the engine is operating under normal load. During startup, the gap should be large to allow for thermal expansion of the blade and rotor in order to prevent rubbing of the blade tip. This occurs because the blades tend to grow thermally faster than the outer shrouds and casing. Thus, during engine warm-up to steady state operating conditions, the blade tip could grow such that the tip would rub and reduce excessively and produce a permanent gap of large spacing. When normal operating conditions are met, the gap should be as narrow as possible to improve performance. When normal operating conditions are met, the shaft drive members are moved to the extended position such that the ring segments are moved inward to make the gap the smallest of the two positions.

Prior art outer shrouds use a plurality of shroud segments forming an annular ring around the blades. There are generally eight or more of these segments, and each includes a separate motor or drive device to move the respective segment in the radial direction to control the gap between the blade tip and the inner surface of the segment. The more shroud segments that are used, the more gaps between adjacent segments exist. The more gaps that exist, the more leakage occurs across the gaps.

Thus, it is an objective of the present invention to reduce the number of gaps in shroud segments used in a gas turbine engine, and to minimize the gap between the rotary blade tips and the shroud segments in order to reduce the bypass of the gas stream at the blade tip and shroud segment.

Another objective is to simplify the complexity of the shroud segment assembly and drive motor means, and to provide a more even gap along the complete circumference of the shroud ring assembly.

BRIEF SUMMARY OF THE INVENTION

The present invention is directed to a shroud tip clearance control ring in a gas turbine engine, the shroud tip clearance control ring being formed of only two segments, the two segments forming an annular shroud ring assembly around the blade tips. Each shroud ring segment includes an end having a pin that can slide within a slot located in the engine casing. Each pin is abutted against a cam surface that, when moved, produces a displacement of the pin in a direction that increases the radial diameter of the shroud segment ring assembly such that a gap between a blade tip and the shroud segment remains substantially the same throughout a complete 360 degree rotation of the blade tip.

By using only two ring segments, the number of gaps between adjacent shroud segments is reduced to two instead of eight gaps between adjacent shroud segments in an eight segment shroud assembly. Using the two ring segments also reduces the number of drive motor means to two as well.

DETAILED DESCRIPTION OF THE INVENTION

Figure 1:
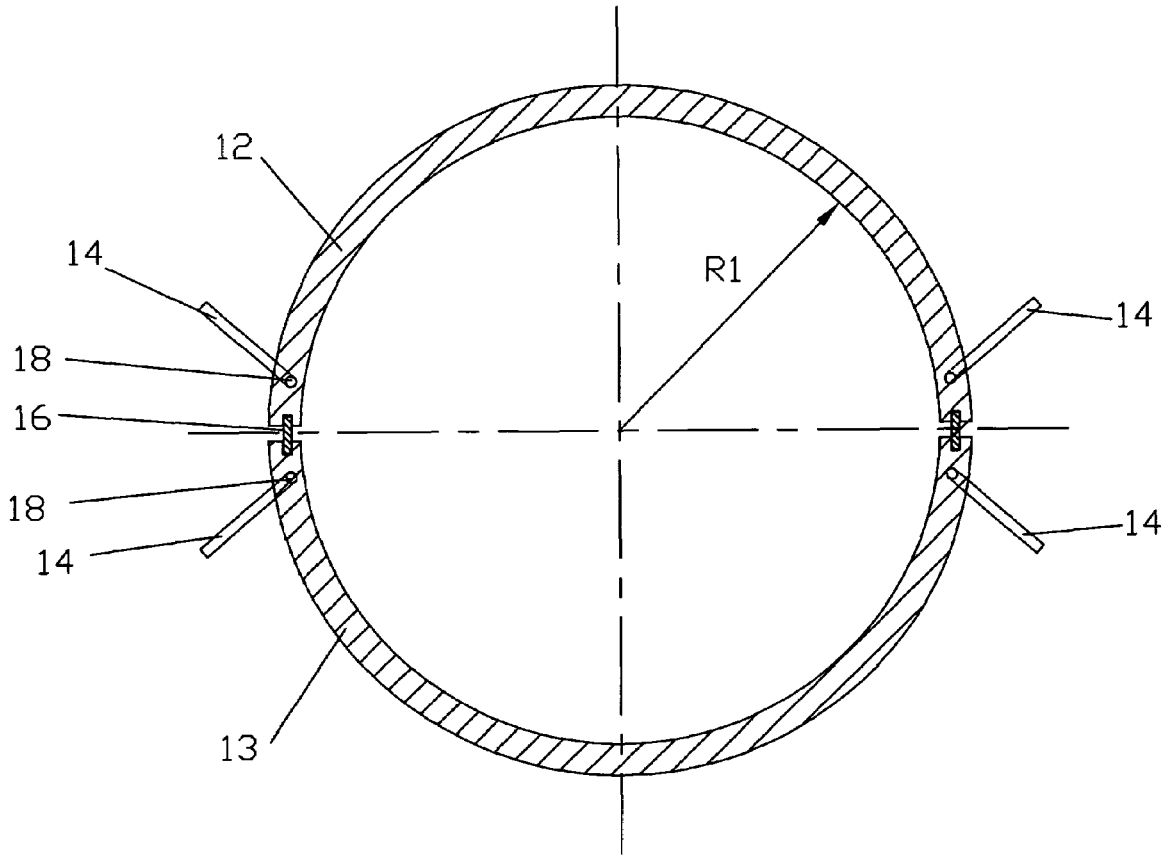
FIG. 1 shows the shroud tip clearance control ring of the present invention having two ring segments.

The present invention is a shroud ring assembly used in a gas turbine engine, the shroud ring assembly forming a blade outer air seal (BOAS) between an inner surface of the shroud segments and a tip of the rotating blade. The shroud ring is formed of only two segments or half rings 12 and 13 as seen in FIG. 1. The ends of the ring segments each include a seal member 16 located in a slot of the ring segment. The seal member 16 is capable of sliding within the slots to provide a seal between adjacent ring segments when the gap between adjacent ring segments changes. Near an end of each ring segment 12 and 13 includes a pin member 18 extending along a direction parallel to the rotary axis of the turbine engine. Each pin 18 slides within a slot 14 formed within the casing of the turbine. In an alternate embodiment of this invention, the slot can be located in the ring segment and the pin can extend into the slot from the casing or a member secured to the casing. Either way the function of the pin sliding in the slot is the same.

Figure 2:
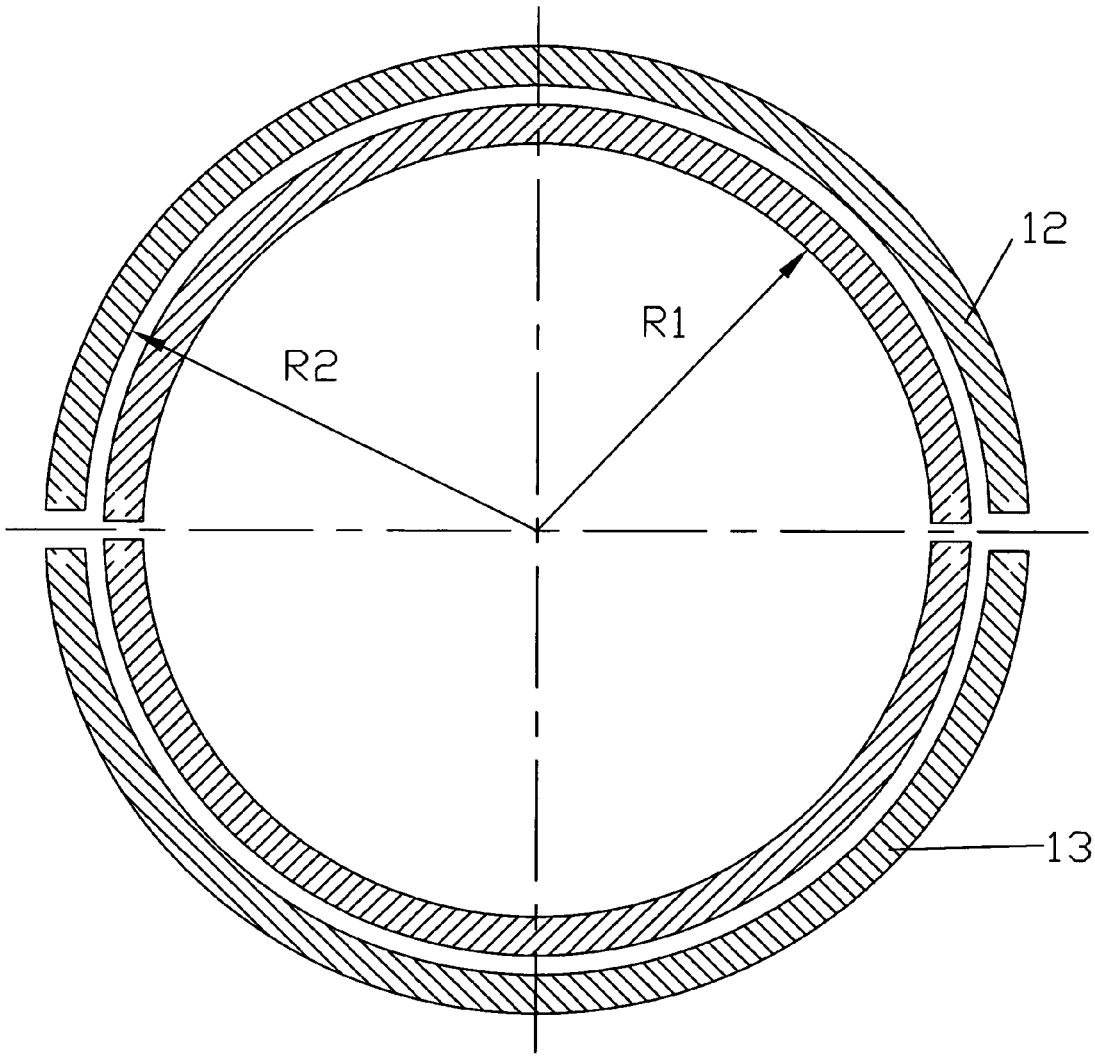
FIG. 2 shows the shroud tip clearance control ring of the present invention located in an inward position represented by R1 and an outward position represented by R2.
Figure 3A:
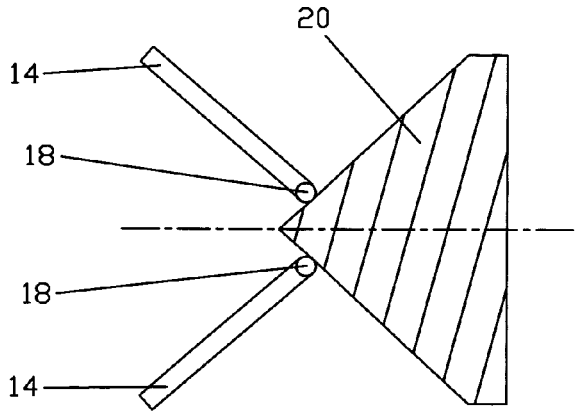
FIGS. 3*a* and 3*b* shows a detailed view of the slots, the pins, and the block member that moves the pins to the various positions in order to increase the radius of the ring segments.
Figure 3B:
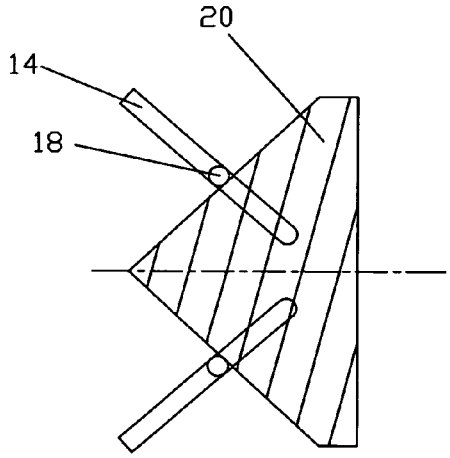

Abutting each of the two pins on an adjacent end of the ring segment is a block member 20 (FIGS. 3*a* and 3*b*) that includes two angled abutting surfaces in contact with the two pins 18. The block member 20 is connected to a drive member (not shown) that moves the block member 20 along a direction parallel to a horizontal center line shown in FIG. 1. As the block member 20 moves leftward as shown in FIGS. 3*a* and 3*b*, the pins 18 are forced to follow in the direction of the slots 14. Alignment of the slots 14 are such that movement of the pins will produce a radial expansion of the ring segment ends from a radial spacing R1 to R2 as shown in FIG. 2. The radial distances R1 and R2 are substantially the same distance around a 360 degree angle for both ring segments 12 and 13. The slots are angled at 45 degrees to each of the two centerlines shown in FIG. 1, the horizontal centerline and the vertical centerline. At 45 degrees, movement of the pins will produce displacement along the horizontal centerline of equal distance to a displacement parallel to the vertical centerline. The ring segments 12 and 13 are of such thickness that they provide a rigid structure to form the gap between the blade tip, but are also flexible enough to allow for the segment ring radial expansion discussed above.

The angular arrangement of the slots 14 is necessary to provide an equal radial increase of the shroud ring assembly throughout a full 360 degrees of the ring. Displacing the ring ends along a line parallel to a horizontal axis in FIG. 1 would increase the radial distance R1 at this location in the ring assembly, but the radial distance at the top and bottom of the ring assembly would not be changed. The blade gap would not be even around the full 360 degree rotation of the blade. The gap would be greatest at the 90 degree and 270 degree positions on the ring in FIG. 1, and would be a minimum at the zero and 180 degree positions. The same problem would occur if the ring segments 12 and 13 where displaced in a direction along the vertical axis in FIG. 1. The gap would be greatest at the zero and 180 degree positions in FIG. 1, and would be unchanged and at a minimum at the 90 and 270 degree positions of the ring assembly. Thus, the angled slots 14 provide for movement of the segments ends along a line that produces a radial increase of the ring segments substantially equal along a complete 360 rotation of the ring segments.

In operation, a typical change between a radial inward position and a radial outward position could be on the order of 3 mm. FIG. 2 shows the rings 12 and 13 in the inward position forming a small gap R1 and in the outward position forming the larger gap R2. The seal members 16 slide within the slots as the ring halves move away from each other during movement of the block members 20 into the inward retracted position. During startup of the engine, when the blades, rotor discs, shrouds, and casing are cool, the shroud ring segments would be positioned in the R2 position to produce a largest gap between the blade tip and the shroud inner surface. As the engine heats up the blades growth radially due to thermal growth. After a certain time period, the blades will stop growing in the radial direction, but the casing and the shroud ring will continue to grow radially. When the casing and the shroud ring stops growing in the radial direction, the shroud ring is then moved to the position represented as R1 in FIG. 2. at this time period and ring position, the gap is then at a minimum and the bypass across the BOAS is reduced to a minimum, improving the engine efficiency while reducing the number of pieces that form the shroud ring assembly and the motor drive means associated with movement of the segments.

Using only two ring halves instead of the many-segmented ring (like 4 or 8 segments) reduces the many leak paths between the blade tip and the shroud, and provides for a more precise radial distance to the inner surface of the shroud member forming the gap between the blade tips. The ring is formed of a thickness that will allow for some flexibility in the rings so that the inner circumference can vary between the two positions.

I claim the following:

1. A turbo machine having a rotary blade operating within the turbo machine, the turbo machine including an annular shroud ring having an inner surface and forming a blade outer air seal between a tip of the rotating blade and the inner surface of the shroud ring, the annular shroud ring being displaceable between a radial inward position and a radial outward position, the improvement comprising:

the shroud ring comprising of two half ring shroud segments each having segment ends; and, blade segment drive means to move the shroud segment ends along a line such that a radius of the shroud ring is substantially the same around a full 360 degree circle of the shroud ring.

2. The turbo machine of claim 1, and further comprising:

the blade segment drive means comprising a pin extending from one of the shroud segment or the casing;

a slot in the other of the shroud segment or the casing in which the pin can slide; and, a block member having an abutting surface to engage the pin.

3. The turbo machine of claim 2, and further comprising:

the slot being positioned at substantially a 45 degree angle with respect to a horizontal and a vertical line passing through a rotational axis of the shroud ring.

4. The turbo machine of claim 1, and further comprising:

a slot located in the shroud segment end; and, a seal member slidably fitted within the slot of the shroud segment end.

5. The turbo machine of claim 1, and further comprising:

the blade segment drive means comprises a drive motor means to position the shroud ring at a radial inward position and a radial outward position.

6. A process for controlling a gap between a rotary blade and a shroud segment in a turbo machine, the process comprising the steps of:

providing for a shroud ring to comprise two shroud half ring segments;

moving ends of the shroud ring segments along a line to change the radius of the shroud ring such that the radius around 360 degrees of the ring is substantially the same;

providing for a pin on one of a shroud segment or a stationary part of a casing; and, sliding the pin along a slot located in the other of the shroud segment or the stationary part of the casing.

7. The process for controlling a gap between a rotary blade and a shroud segment in a turbo machine of claim 6, and further comprising the step of:

positioning the slot at an angle of substantially 45 degrees from both a horizontal axis and a vertical axis that both pass through a rotational center of the shroud ring.

* * * * *